United States Patent [19]

Minematu et al.

[11] Patent Number: 4,859,903

[45] Date of Patent: Aug. 22, 1989

[54] ULTRAVIOLET FLUORESCENT LAMP FOR ACCELERATED EXPOSURE TEST ON POLYMER

[75] Inventors: Yoiti Minematu, Tokyo; Toshio Tajima, Hiratsuka; Shigeharu Nakajima, Tokyo, all of Japan

[73] Assignees: Yoiti Minematu, Tokyo; Sankyo Denki Co., Ltd., Kanagawa; Nichia Kagaku Kogyo K. K., Tokushima, all of Japan

[21] Appl. No.: 163,298

[22] Filed: Mar. 2, 1988

[30] Foreign Application Priority Data

Mar. 4, 1987 [JP] Japan ..... 62-49831

[51] Int. Cl.[4] ..... H01J 61/30; H01J 61/44

[52] U.S. Cl. ..... 313/487; 313/486; 313/493

[58] Field of Search ..... 313/493, 486, 487; 252/301.4 P

[56] References Cited

U.S. PATENT DOCUMENTS 3,104,226 9/1963 Struck ..... 252/301.4
3,692,689 9/1972 Hoffman .
4,370,595 1/1983 Willemsen et al. ..... 313/493 X
4,499,403 12/1985 Leppelmeier et al. ..... 313/487
4,645,969 2/1987 Hoffman ..... 313/487
4,703,224 10/1987 Rattray et al. ..... 313/487

FOREIGN PATENT DOCUMENTS 60-15544 1/1985 Japan .

OTHER PUBLICATIONS

J. Electrochem. Soc. 118 1508 (1971), "Effect of Thorium on $Ce^{+3}$ Phosphors".

*Primary Examiner*—Palmer C. DeMeo
*Attorney, Agent, or Firm*—Nixon & Vanderhye

[57] ABSTRACT

An ultraviolet fluorescent lamp for accelerated artificial test on polymer is disclosed, which comprises a bulb consisting of an ultraviolet-ray-transmitting glass with the absorbance thereof having a wavelength of 280 nm being 1 to 3 with respect to ultraviolet rays, the inner surface of the bulb being provided with a phosphor having a characteristic that causes radiant energy transmitted through the bulb to increase by 5 to 17 times for every wavelength increase of 5 nm in a wavelength range of 295 to 310 nm, and that it has a radiant energy peak in a wavelength of 305 to 325 nm.

9 Claims, 5 Drawing Sheets

ULTRAVIOLET FLUORESCENT LAMP FOR ACCELERATED EXPOSURE TEST ON POLYMER

BACKGROUND OF THE INVENTION

1. Field of Invention

This invention relates to an ultraviolet fluorescent lamp and, more particularly, to an ultraviolet fluorescent lamp used for accelerated artificial exposure test on polymer material.

2. Description of the Related Art

For the testing of the weatherability of polymer materials such as paint films and synthetic resins, an accelerated artificial exposure apparatus is used. Such apparatus ideally uses a light source, which has a spectral distribution similar to that of sunlight in the entire spectral range. However, it is very difficult to realize such a light source. Xenon lamps have the most similar spectral distribution to that of sunlight among presently available light sources. The xenon lamp, however, is held at very high temperatures during its operation. Therefore, when it is operated, i.e., held "on", for a long time, solarization of the glass constituting its bulb occurs, resulting in early reduction of short wavelength ultraviolet rays in the neighborhood of 300 nm.

Ultraviolet fluorescent lamps are also used as the light source of accelerated artificial exposure apparatus. With these lamps, the solarization of glass does not occur owing to low lamp temperature. In addition, changes of the spectral distribution with time are not substantially influenced by the wavelength. With the ultraviolet fluorescent lamp, however, the irradiance is subject to the influence of the lamp temperature. Therefore, it is necessary to control the ambient temperature independently of the irradiated material.

An erythemal or sun lamp (FL20S·E), which is one kind of ultraviolet fluorescent lamp, has a spectral irradiance characteristic as shown by curve A in FIG. 1. Its spectral irradiance in a wavelength range of 270 to 295 nm is considerably high compared to that of sunlight as shown by curve B. With sunlight, the irradiance is reduced sharply as the wavelength becomes less than 300 nm. More specifically, the irradiance is reduced extremely to, for instance, 0.55, 0.024 and $8\times10^{-5}$ $mW\cdot m^{-2}\cdot nm^{-1}$ for respective wavelengths of 300, 295 and 290 nm. In other words, for 295 nm it is only 1/23 of its value for 300 nm. and for 290 nm it is only about 1/700,000. For this reason, the irradiance of sunlight for 290 nm is practically thought to be zero. That is, in nature there are no ultraviolet rays having wavelengths less than 295 nm, and organic materials on the glove will be greatly affected by ultraviolet rays in such a wavelength range. For this reason, when a ultraviolet fluorescent lamp for the accelerated artificial exposure testing on polymer material radiates ultraviolet rays in a wavelength range of 290 to 295 nm, these ultraviolet rays will cause abnormal degradation of the polymer material. This leads to serious errors in the result of the accelerated artificial exposure test.

It is said that the spectral irradiance characteristic of an ultraviolet fluorescent lamp for the accelerated artificial exposure test can be controlled through control of the spectral transmittance of the glass constituting the lamp bulb. This technique is disclosed in Japanese Patent Disclosure No. 60-15,544. More specifically, the disclosure discloses an accelerated artificial exposure test apparatus which uses a bulb consisting of glass, with which the cut-on wavelength of transmittance is 295 to 300 nm. However, no glass having such characteristic has yet been developed.

FIG. 2 shows the transmittance and absorbance of glasses used in two different fluorescent lamps used for other purposes. Curve C represents the transmittance of an ultraviolet-ray-transmitting glass, which is used as bulb material of a sun lamp (i.e., FL20S·E lamp using $(Ca, Zn)_3(PO_4)_2$: Tl as phosphor) and has a cut-on transmittance of about 1% for a wavelength of 275 nm. Curve D shows the transmittance of a normal soda lime glass, which is used as bulb material of a blacklight lamp (using lead-activated barium silicate as phosphor) as one kind of ultraviolet fluorescent lamp. In the ordinate of the graph of FIG. 2, the transmittance is shown on a logarithmic scale. As is seen from curve C, with the ultraviolet-ray-transmitting glass the absorbance is not sharply increased with reducing wavelength in the neighborhood of a wavelength of 300 nm, so that radiant energy in a wavelength range of 290 to 300 nm can not be sufficiently attenuated. The normal glass, on the other hand, shows high absorbance in the neighborhood of 300 nm, as seen from curve D. However, the extent of decrease of absorbance with increasing wavelength (i.e., the slope of the curve) is extremely gentle compared to the case of sunlight.

As has been shown, although the absorbance of glass is controllable between curves C and D, the slope of curve can not be varied. For this reason, glass which well transmits ultraviolet rays with a wavelength of 300 nm also well transmits ultraviolet rays with wavelengths of 290 to 295 nm, while glass well absorbing ultraviolet rays of 290 to 300 nm also well absorbs ultraviolet rays of 290 to 295 nm. Therefore, it is difficult to simulate the spectral irradiance characteristic of sunlight with that of an ultraviolet fluorescent lamp by controlling the sole spectral transmittance characteristic of the glass constituting the lamp bulb.

SUMMARY OF THE INVENTION

An object of the invention is to provide an ultraviolet fluorescent lamp for accelerated artificial exposure testing on polymer material, which has a spectral irradiance characteristic more similar to that of sunlight compared to prior art ultraviolet fluorescent lamps so that it permits test results with less errors to be obtained.

The ultraviolet fluorescent lamp for accelerated artificial exposure testing on a polymer according to the invention has a bulb consisting of ultraviolet-ray-transmitting glass, the absorbance of which with respect to ultraviolet rays with a wavelength of 280 nm is 1 to 3. The inner surface of the bulb is provided with phosphor, with which radiant energy transmitted through the bulb is increased by 5 to 17 times for every wavelength increase of 5 nm in a wavelength range of 295 to 310 nm and also there is a radiant energy peak in a wavelength range of 305 to 325 nm. The phosphor has a spectral distribution, which has a sufficiently sharp rise on the short wavelength side.

With the ultraviolet fluorescent lamp noted above, i.e., one having a bulb, which consists of an ultraviolet-ray-transmitting glass with the absorbance thereof with respect to ultraviolet rays of 280 nm being 1 to 3 and has its inner surface provided with phosphor having a spectral irradiance characteristic that the radiant energy transmitted through it is increased by 5 to 17 times for every wavelength increase of 5 nm in a radiation wavelength range of 295 to 310 nm, the spectral irradiance characteristic resides in the hatched region in FIG. 1 provided the radiant energy for a wavelength of 295 nm is 0.4 $mW \cdot m^{-2} \cdot nm^{-1}$. Further, the phosphor has a radiant energy peak in a wavelength range of 305 to 325 nm, that is, it has a radiant energy peak in region E shown in FIG. 1.

The spectral irradiance characteristic, which is possessed by such ultraviolet fluorescent lamp, is similar to the spectral irradiance characteristic of sunlight, as shown by curve B, in a wavelength range around 300 nm or less which is important for accelerated artificial exposure tests on polymer materials. Particularly, with sunlight the radiant energy increases sharply in a wavelength range from 295 to 310 nm, but the rate of increase is gradually reduced from 310 nm, as is obvious from curve B.

The ultraviolet fluorescent lamp according to the invention has a radiant energy peak in a wavelength range of 305 to 325 nm, and hence its spectral irradiance characteristic in the neighborhood of 310 nm is similar to that of sunlight. In other words, it simulates the spectral irradiance characteristic of sunlight in the neighborhood of 310 nm by making effective use of such character of the phosphor having a radiant energy peak in a predetermined wavelength range that the rate of increase of radiant energy is reduced gradually as the wavelength approaches the peak.

Thus, in the ultraviolet fluorescent lamp according to the invention, the spectral transmittance characteristic of the ultraviolet-ray-transmitting glass and the spectral irradiance characteristic of the phosphor are combined such that ultraviolet rays in a wavelength range less than 280 nm are sufficiently attenuated while short wavelength ultraviolet rays of 253 nm exciting the phosphor are cut off, and thus radiant energy increase rate in the neighborhood of a wavelength range of 295 to 310 nm and spectral irradiance characteristic in the neighborhood of 310 nm approximate those of sunlight. Therefore, when the ultraviolet fluorescent lamp according to the invention is used for accelerated artificial exposure testing on polymer, unlike the prior art fluorescent lamp, there occurs no abnormal degradation of polymer due to ultraviolet rays of 300 nm or less, so that it is possible to obtain test results with less errors.

DETAILED DESCRIPTION OF THE PREFERRED EMBODIMENTS

Now, the invention will be described in greater detail in connection with the preferred embodiments thereof.

Figure 4:
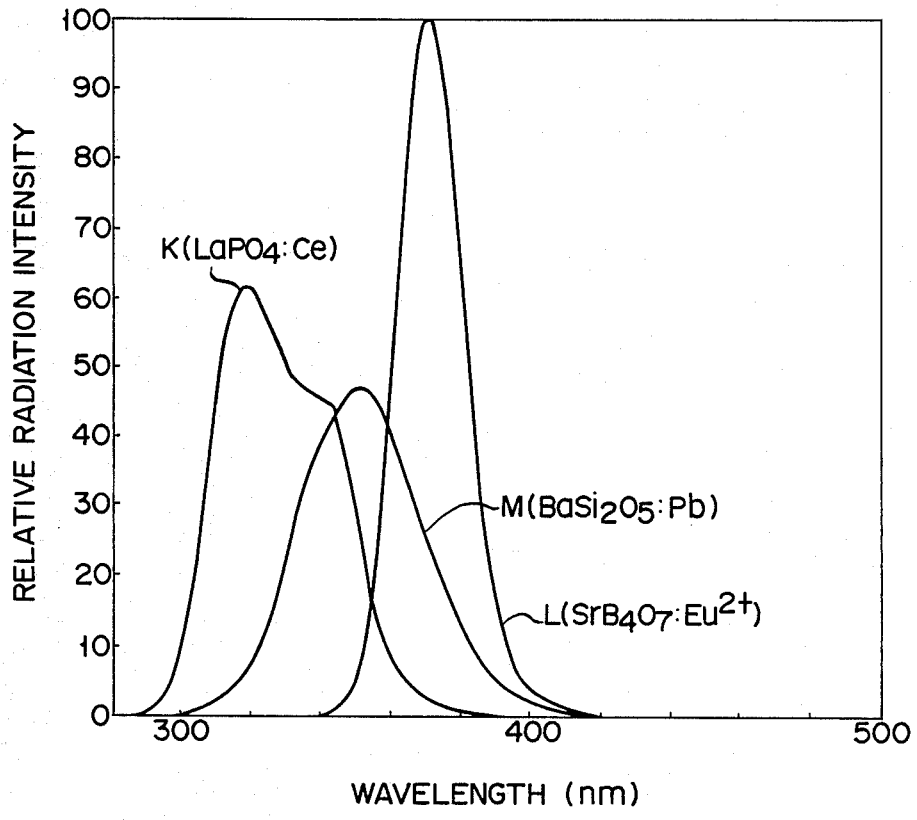
FIG. 4 is a graph showing a relative intensity characteristic of a phosphor used according to the invention.

In the ultraviolet fluorescent lamp according to the invention, the phosphor used may be of any phosphor type in which its radiant energy, when transmitted through the bulb of ultraviolet-ray-transmitting glass, increases by 5 to 17 times for every wavelength increase of 5 nm in a wavelength range of 295 to 310 nm, and also which has a radiant energy peak in a wavelength range of 305 to 325 nm. As a typical example of the phosphor satisfying these characteristics, there has hitherto been used cerium-activated lanthanum phosphate ($LaPO_4$: Ce). This phosphor is excited by an electron beam, and it is used for cathode-ray tubes. The amount of Ce incorporated in this phosphor is usually controlled to be in a range of 0.0001 to 0.1 mol, as disclosed in U.S. Patent Specification No. 3,104,226. When using this phosphor for the ultraviolet fluorescent lamp according to the invention, satisfactory results can be obtained by controlling the amount of Ce so as to be in a range of 0.05 to 0.4 mol, preferably in a range of 0.1 to 0.3 mol. $LaPO_4$: Ce with the Ce amount controlled in the range noted above, has a high radiant energy peak at a wavelength of about 320 nm and also has a considerable peak at 340 nm. Therefore, it has a spectral radiant energy characteristic which is best suited for use with the ultraviolet fluorescent lamp according to the invention, as shown by curve K in FIG. 4.

The well-known phosphate glass and silicate glass may be used as the ultraviolet-transmitting glass for the bulb material of the ultraviolet fluorescent lamp according to the invention, these glasses contain less impurities and have an absorption band in the ultraviolet range like iron and titanium. Their specific examples are Corex, Uviol and Vita.

Now, examples of the invention will be given.

EXAMPLE 1

A 20-W ultraviolet fluorescent lamp was fabricated by coating 1.5 to 3 g of $La_{0.8}PO_4$:$Ce_{0.2}$ phosphor on the inner surface of a tube having a diameter of 32 mm consisting of ultraviolet-transmitting glass, containing Ar gas and Hg vapor in the bulb and sealing the opposite ends thereof with filaments provided at these ends. The spectral irradiance characteristic of this lamp was measured, and the curve F-shown in FIG. 1 could be obtained.

Figure 2:
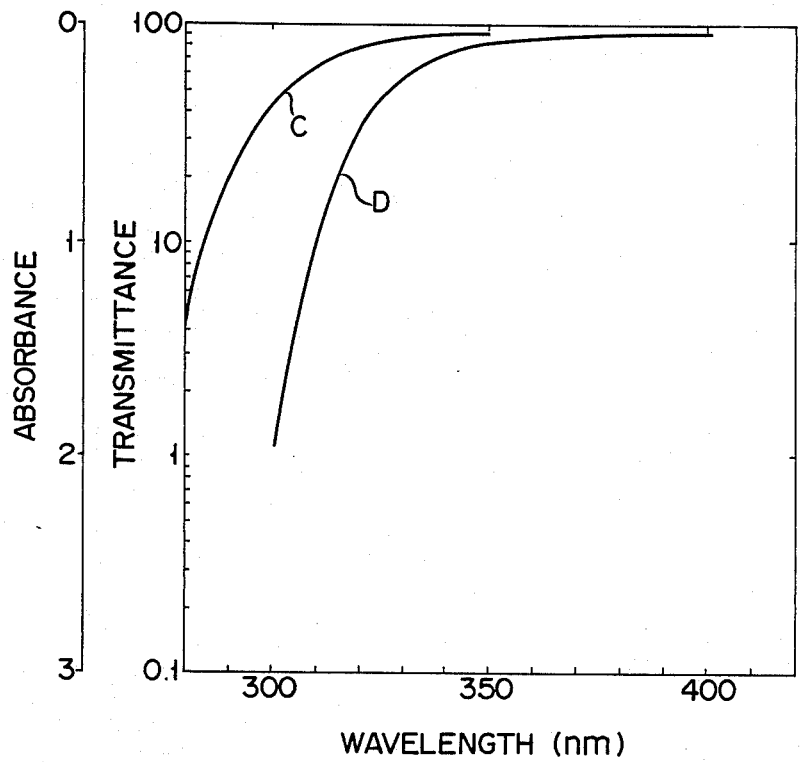
FIG. 2 is a graph showing the spectral transmittance of normal glass and that of ultraviolet-ray-transmitting glass.

The ultraviolet-transmitting glass used had a spectral transmittance characteristic as shown by curve C in FIG. 2. As is seen in curve C, this glass has an absorbance, with respect to ultraviolet rays of 280 nm, of about 1.5. For use with the ultraviolet fluorescent lamp according to the invention, glass having an absorbance of 1.2 to 2.5 with respect to ultraviolet rays of 280 nm is best suited. However, glass with an absorbance values of 1 to 3 with respect to this wavelength may be used if the slight errors, thus caused can be tolerated.

Figure 1:
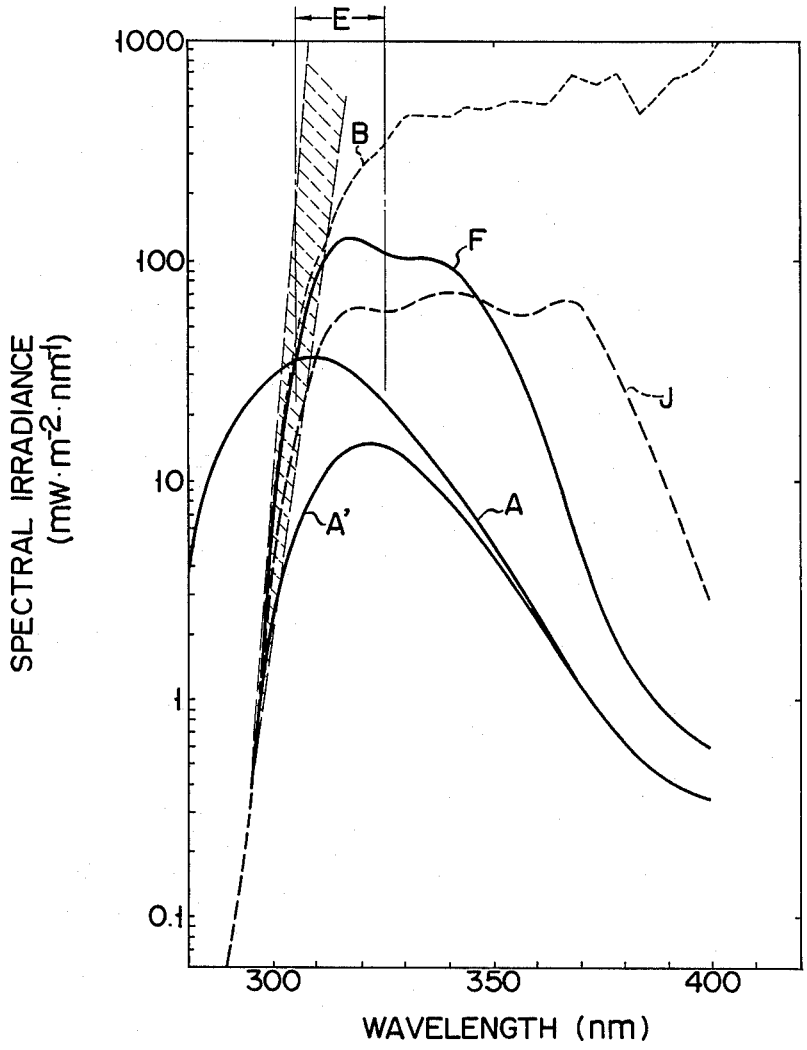
FIG. 1 is a graph showing a spectral irradiance characteristic of an ultraviolet fluorescent lamp according to the invention and that of a prior art ultraviolet fluorescent lamp.

Curve F in FIG. 1 shows a spectral irradiance characteristic obtained by measuring the position of the irradiance at a distance of 130 mm from the surface of a single lamp. The slope of this curve F in a wavelength range less than 310 nm almost perfectly coincides with that of curve B of sunlight. The phosphor used had not only a radiant energy peak at 320 nm but also had another peak in the neighborhood of 340 nm. Above 310 nm, the radiant energy is reduced compared to sunlight. However, this lamp is suited as a light source for testing a polymer material, the quality of the polymer material being subject to degradation when exposed to ultraviolet rays in the neighborhood of 310 nm. In the accelerated artificial exposure test, not a single lamp but a plurality of lamps are used in a parallel arrangement, so that the radiant energy of a wavelength less than 310 nm is sufficient. The emission lines of mercury in the neighborhood of 289 nm were very weak and almost incapable of measurement.

Curve A in FIG. 1 represents the spectral irradiance characteristic of a prior art sun lamp (FL20S·E) using $(CaZn)_3(PO_4)_2$: Tl as its phosphor, while curve A' represents the characteristic of a sun lamp wherein normal glass has been substituted while using the same phosphor. When a normal glass bulb is used in the sun lamp with the phosphor, the radiant energy is absorbed in the glass and is not effectively emitted. Another disadvantage is that the incline of the rising portion of the curve is less steep than that of the sunlight.

Figure 3:
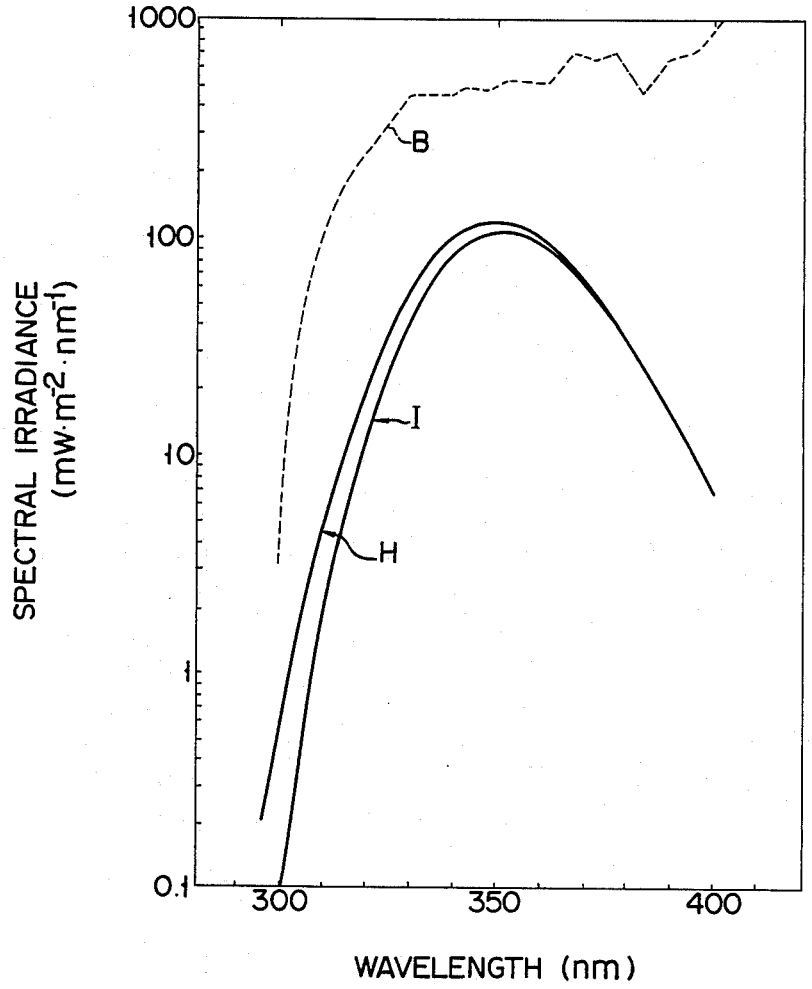
FIG. 3 is a graph showing a spectral irradiance characteristic of a blacklight lamp.

Curve H in FIG. 3 represents a spectral irradiance characteristic obtained in the case where an ultraviolet-transmitting glass of a sun lamp is used for the bulb of a blacklight lamp using $BaSi_2O_5$: Pb as phosphor, and curve I represents the characteristic of a blacklight lamp using normal soda lime glass. Both of these characteristics alike are similarly inferior to the characteristic of sunlight (curve B).

Even the xenon lamp, which is said to be generally excellent, is inferior in its spectral irradiance characteristic, to the characteristic of the present embodiment of the ultraviolet fluorescent lamp as shown by curve F.

EXAMPLE 2

In order to extend the ultraviolet wavelength coverage to approximately 370 nm, a phosphor was used, which was obtained by mixing, 36.4% by weight of cerium-activated lanthanum phosphate phosphor used in Example 1, with other rare earth phosphors, i.e., 5.5% by weight of europium-activated strontium borate ($SrB_4O_7$: $Eu^{2+}$) and 58.1% by weight of lead-activated barium-activated silicate ($BaSi_2O_5$: Pb), and a 20-W normal type lamp was fabricated by the same well-known method as in Example 1 using a bulb of ultraviolet-transmitting glass. This lamp had a spectral irradiance characteristic as shown by curve J in FIG. 1.

$SrB_4O_7$: $Eu^{2+}$, used as phosphor, is capable of controlling the incorporated amount of Eu in a range of 0.01 to 0.02 mol. In this example, it was used in 0.01 mol. $BaSi_2O_5$: Pb, on the other hand, is capable of controlling the incorporated amount of Pb in a range of 0.003 to 0.03 mol. In this example, it was incorporated by 0.01 mol.

In this example, the rising (cut on) and falling (cut off) portions of the curve were determined by $LaPO_4$ ; Ce and $SrB_4O_7$: $Eu^{2+}$, these phosphors having sharp spectral distributions, while $BaSi_2O_5$: Pb, having a broad spectral distribution, was used to make up for an intermediate wavelength range, for approximation of the characteristic of sunlight. The relative radiation intensity was determined such that three peaks having substantially the same level were provided between 310 and 370 nm. It is possible to approximate the relative radiation intensity characteristic of sunlight by varying the proportions of the three different phosphors noted above. By approximating the relative radiation intensity of sunlight in a range of 310 to 370 nm the more closely, the spectral irradiance is reduced the more for a wavelength range less than 320 nm, over which wavelength range the polymer subjected to accelerated exposure is mainly degraded. The lamp obtained in this example is suited for testing sensitive materials, having a degradation wavelength ranging approximately between 320 and 370 nm, whereas the spectral irradiance of the lamp, 310 nm, is low compared to the lamp of Example 1. The proportion of $SrB_4O_7$: $Eu^{2+}$ mixed with $LaPO_4$: Ce can be controlled to be in a range of 5 to 30 parts by weight for every 100 parts by weight of $LaPO_4$: Ce. The proportion of $BaSiO_5$: Pb, on the other hand, can be controlled to be in a range of 80 to 300 parts by weight for every 100 parts of $LaPO_4$: Ce.

With the ultraviolet fluorescent lamp according to the invention, the ultraviolet radiant output of the phosphor may be increased by several times by constructing a high output type lamp with its electrode filaments and so fourth being of an increased size.

Further, the invention is applicable to energy-saving fluorescent lamps having small outer diameters (of 26 to 29 mm) and containing sealed Ar—Kr or Ne—Kr gas, these lamps being currently in widespread use. Such a structure may be applied to an aperture type lamp.

Neither the lamp of Example 1 nor Example 2 can accurately evaluate the weatherability of a material, which has a degradation wavelength range lying within the long wavelength range. In such a case, the lamp of Example 1 or 2 is desirably used in combination with a light source, which has a spectral distribution extending up to the visible range, e.g., the xenon lamp or carbon arc lamp. In this case, the ultraviolet fluorescent lamp is responsible for the accurate reproducibility of the short wavelength range.

EXAMPLE 3

Polycarbonate film was subjected to an accelerated artificial exposure test using the ultraviolet fluorescent lamp in Example 2 as a light source, and the results of the test were compared with an outdoor exposure test.

Figure 5:
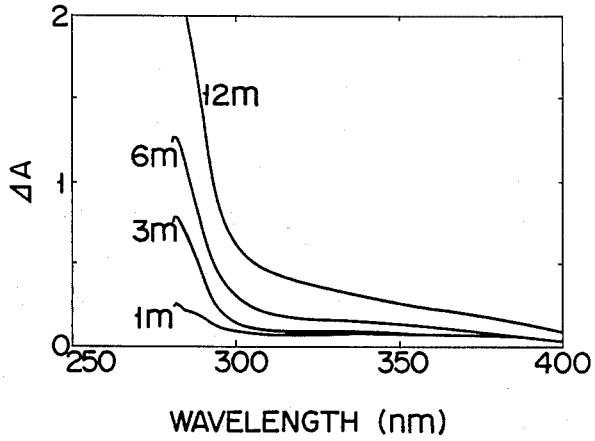
FIG. 5 is a graph showing the results of an accelerated artificial exposure test using an ultraviolet fluorescent lamp according to the invention.
Figure 6:
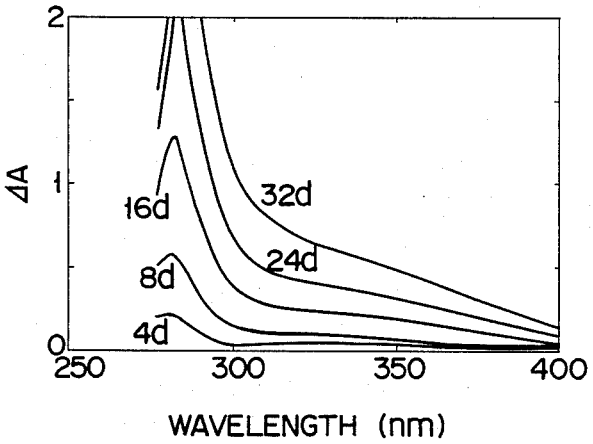
FIG. 6 is a graph showing the results of an outdoor exposure test.
Figure 7:
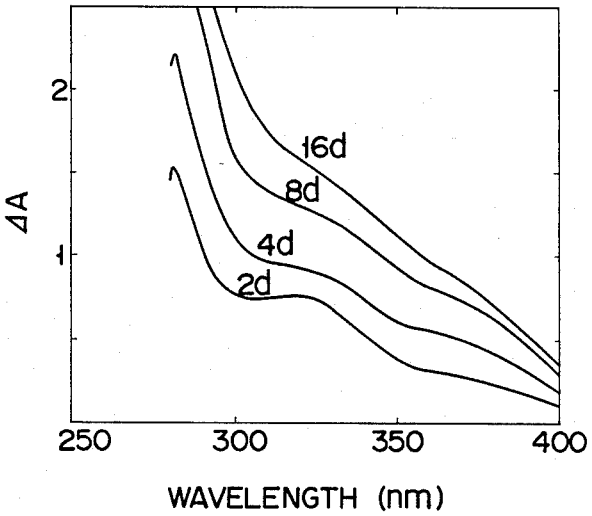
FIG. 7 is a graph showing the results of an accelerated artificial exposure test using a combination of prior art lamps.

More specifically, a sample was irradiated for a total of twelve weeks by using twelve ultraviolet fluorescent lamps employed in Example 2 and vertically and circumferentially arranged, and replacing two of them every two weeks. The resulting degree of degradation to the sample was determined by measuring the absorbance difference $\Delta A$ by means of a spectral absorbance measurement device. FIG. 5 shows the results of the test. FIG. 6 shows the results of an outdoor exposure test. FIG. 7 shows the results of an accelerated artificial exposure test conducted by using a combination of six commercially available sun lamps (FL 20S·E) and six black light lamps (FL 20 BL) as light source.

As can be seen from FIGS. 5 to 7, the results, of the test using the lamp in Example 2 and the outdoor exposure test, are substantially the same in their tendency to increase absorbance. In the case of the combination of prior art lamps, however, the rate of absorbance increase is very high, and also abnormal absorption appears in the neighborhoods of 320 and 380 nm in the initial stage of degradation, and the absorbance is subsequently reduced. This indicates abnormal deterioration of the mechanism.

What is claimed is:

1. An ultraviolet fluorescent lamp for accelerated artificial test on polymer, comprising a bulb having an ultraviolet-ray-transmitting glass with an absorbance of 1 to 3 with respect to ultraviolet rays having a wavelength of 280 nm, the inner surface of said bulb being provided with a phosphor having a characteristic that causes radiant energy transmitted through said bulb to increase by 5 to 17 times for every wavelength increase of 5 nm in a wavelength range of 295 to 310 nm, and that it has a radiant energy peak in a wavelength range of 305 to 325 nm.

2. The ultraviolet fluorescent lamp according to claim 1, wherein the absorbance of said ultraviolet-ray-transmitting glass is 1.2 to 2.5 with respect to ultraviolet rays having a wavelength of 280 nm.

3. The ultraviolet fluorescent lamp according to claim 1, wherein said phosphor contains cerium-activated lanthanum phosphate ($LaPO_4$: Ce), the amount of cerium substituted for La being 0.05 to 0.4 mol.

4. The ultraviolet fluorescent lamp according to claim 3, wherein the amount of cerium substituted for La is 0.1 to 0.3 mol.

5. The ultraviolet fluorescent lamp according to claim 1, wherein a first additive phosphor having a radiant energy peak in a wavelength range of 340 to 360 nm and a second additive phosphor having a radiant energy peak in a wavelength range of 360 to 380 nm, are mixed to said phosphor.

6. The ultraviolet fluorescent lamp according to claim 5, wherein said first additive phosphor is $BaSi_2O_5$: Pb, and said second additive phosphor is $SrB_4O_7$: $Eu^{2+}$.

7. The ultraviolet fluorescent lamp according to claim 6, wherein the amount of Eu substituted for Sr in said $SrB_4O_7$: is 0.005 to 0.02 mol.

8. The ultraviolet fluorescent lamp according to claim 7, wherein the amount of Eu substituted for Sr in said $SrB_4O_7$: $Eu^{2+}$ is 0.01 to 0.02 mol.

9. The ultraviolet fluorescent lamp according to claim 6, wherein said phosphor contains cerium-activated lanthanum phosphate ($LaPO_4$:Ce), and said $BaSi_2O_5$:Pb and $SrB_4O_7$: $Eu^{2+}$ are incorporated respectively by 80 to 300, and 5 to 30 parts by weight for every 100 parts by weight of said $LaPO_4$:Ce.

* * * * *